US008157931B2

(12) United States Patent
Qian et al.

(10) Patent No.: US 8,157,931 B2
(45) Date of Patent: Apr. 17, 2012

(54) CASE HARDENABLE NICKEL-COBALT STEEL

(75) Inventors: Yana Qian, Sunnyvale, CA (US); Gregory B. Olson, Evanston, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 12/459,477

(22) Filed: Jul. 1, 2009

(65) Prior Publication Data

US 2010/0200122 A1 Aug. 12, 2010

Related U.S. Application Data

(60) Provisional application No. 61/133,595, filed on Jul. 1, 2008.

(51) Int. Cl.
*C22C 38/44* (2006.01)
*C22C 38/46* (2006.01)
*C23C 8/22* (2006.01)

(52) U.S. Cl. ..... 148/335; 148/319

(58) Field of Classification Search ..... None
See application file for complete search history.

(56) References Cited

U.S. PATENT DOCUMENTS 6,176,946 B1 * 1/2001 Kuehmann et al. ..... 148/319

FOREIGN PATENT DOCUMENTS

JP 10-219402 * 8/1998
WO WO03/076676 * 9/2003

* cited by examiner

*Primary Examiner* — Stanley Silverman
*Assistant Examiner* — Justin Bova

(57) ABSTRACT

An advanced secondary hardening carburized Ni—Co steel achieves an improved case hardness of about 68-69 Rc together with nominal core hardness of about 50 Rc.

5 Claims, 2 Drawing Sheets

CASE HARDENABLE NICKEL-COBALT STEEL

This application claims benefits and priority of U.S. provisional application Ser. No. 61/133,595 filed Jul. 1, 2008.

CONTRACTUAL ORIGIN OF THE INVENTION

This invention was made with government support under Contract No. DE-FG07-011D14026 awarded by the Department of Energy. The Government has certain rights in the invention.

FIELD OF THE INVENTION

The present invention relates to case hardenable steels and, more particularly, to a secondary hardening Ni—Co steel that can achieve a case hardness of 68-69 Rc (946-1004 Hv) without the formation of primary carbides.

BACKGROUND OF THE INVENTION

Development of high-power-density gear transmissions is heavily relying on advanced gear and bearing materials development, as the requirement for further power density improvement is beyond the capability of gear design engineering itself. Recently Ni—Co secondary hardening steels have shown great potential for next generation gear and bearing applications due to their great combination of strength and toughness and superior fatigue performance. More specifically, in Gear Industry Vision for 2025, it was specified that an advanced gear steel with surface hardness of 70 Rc is desired for the improvement of the power density by 25% every five years A new generation of high performance steels, including Ferrium® C61 and C67 steel families (see U.S. Pat. No. 6,176,946 B1) has been developed. C61 steel has been proven to exceed AISI 9310 in fatigue performance and has been commercialized. The development of C67 steel is still ongoing. U.S. Pat. No. 6,176,946 B1 describes a family of case hardenable, secondary hardening steels that can achieve a high case hardness and superior core strength and toughness without the formation of primary carbides in a Ni—Co—Fe lath martensitic matrix.

SUMMARY OF THE INVENTION

The present invention provides a further advanced case hardenable, secondary hardening steel that achieves a further improved case hardness together with beneficial core hardness without formation of primary carbides.

An illustrative embodiment of the invention provides a secondary hardening steel that consists essentially of, in weight %, 3.7% to 3.73%. Ni; about 9.9% to 10.2% Co, about 5.3% to about 5.4% Cr, about 2.5% to about 2.52% Mo, about 0.20% to about 0.21% V, about 0.1% to about 0.12% C, and balance Fe wherein the case carbon content is about 0.72% weight to about 0.8 weight % to achieve a case hardness of 68-69 Rc (946-1004 Hv). The core carbon content is about 0.1 weight % to about 0.12 weight % C and core hardness is about 50 Rc. The case hardness of 68-69 Rc represents a 35% increase from that of the current best commercial steels. As a result, the steel of the invention possesses superior strength, contact fatigue resistance, wear resistance and prolonged fatigue life. Core toughness was estimated to be greater than 100 ksi√in based on the measured core hardness of 50 Rc.

The present invention is advantageous to provide a case hardenable, secondary hardening steel with improved case hardness and excellent core toughness. The steel can be utilized to fabricate structural, gearing and bearing components that operate at high pressure, high temperature in automobiles, aircrafts, and heavy machines.

Other advantages of the present invention will become apparent from the following detailed description taken with the following drawings.

DETAILED DESCRIPTION OF THE INVENTION

Figure 1:
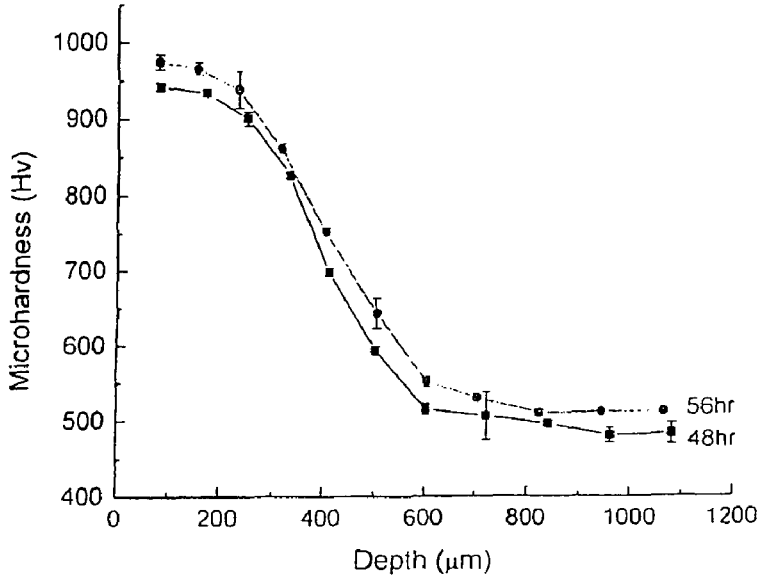
FIG. 1 is a hardness profile of a secondary hardening steel pursuant to an embodiment of the invention called Cryoform 70 steel after processing with a tempering time of 48 hours and 56 hours, respectively.

The present invention provides an improved secondary hardening Ni—Co steel having optimized combinations of concentrations of carbon, nickel, cobalt and metal carbide formers (chromium, molybdenum and vanadium) to produce nano-size strengthening precipitates after the processing of carburizing-quenching-cryogenic treatment-cryogenic deformation-cyclic tempering and thereby achieve the case hardness of 68-69 Rc (Rockwell C) in the steel. The secondary hardening steel pursuant to the invention was designed using a system approach based on thermodynamics and secondary hardening mechanism in Ni—Co high strength steels as described in U.S. Pat. No. 6,176,946, the teachings of which are incorporated herein by reference.

The present invention provides a case hardenable, secondary hardening steel with a high case carbon content of 0.72 wt % or more and a resulting case hardness of 68-69 Rc. Compared to previously developed steel, Ferrium® C61 and the underdeveloped steel Ferrium® C67, the steel pursuant to the invention possesses a higher case hardness and thus higher strength, higher contact and wear resistance and longer fatigue life. Compared to C69 steel, an underdeveloped variant from Ferrium® C67 family, the steel pursuant to the invention has revealed no signs of core embrittlement as observed in C69 steel.

An illustrative embodiment of the invention provides a secondary hardening steel that consists essentially of, in weight %, 3.7% to 3.73% Ni, about 9.9% to 10.2% Co, about 5.3% to about 5.4% Cr, about 2.5% to about 2.52% Mo, about 0.20% to about 0.21% V, about 0.1% to about 0.12% C, and balance Fe wherein the case carbon content is about 0.72% weight to about 0.8 weight % to achieve a case hardness of 68-69 Rc (946-1004 Hv). The core carbon content is about 0.1 weight % to about 0.12 weight % C and a beneficial core hardness is about 50 Rc. Hardness was measured using test standard ASTM E92 [Vickers hardness (Hv) with high load with data then converted to Rockwell C (Rc) hardness scale].

The steel alloying elements Cr, Mo and V are employed to form secondary carbides—$M_2C$ (where M stands for Cr, Mo and V) in the martensite matrix of the steel. These $M_2C$ carbides act as strengthening precipitates during stage IV tempering (400-600° C.). Co is the element utilized to hinder dislocation recovery in the matrix and thus promote the precipitation of fine $M_2C$ strengthening carbides. A fine carbide dispersion not only strengthens matrix efficiently, but also promotes higher toughness. Ni helps improve cleavage resistance in the martensite matrix. Trace amounts of titanium carbides are utilized to pin the grain boundary during solution treatment, thereby limiting grain growth. Impurities, such as phosphorus and sulfur, are minimized through VIM and VAR melting processes. Rare-earth element, such as La, preferably is added to getter impurities. For example, La can be present in an amount of 0.03 weight % of the steel. Boron preferably is also included in the steel composition in an amount of 15-20 ppm by weight to enhance the grain boundary cohesion.

An exemplary secondary hardening steel (referred to as Cryoform 70 steel) pursuant to the present invention has a preferred nominal composition of, in weight %, about 10% Co, about 3.73% Ni, about 5.34% Cr, about 2.52% Mo, about 0.21% V, and balance Fe with a case carbon content of 0.72-0.8 weight % and a core carbon content of about 0.1-0.12 weight %.

An ingot of the exemplary Cryoform 70 steel was prepared from high purity materials by conventional vacuum induction melting (VIM), casting, and solution heat treatment for homogenization and stress relief purposes. A section cut from the ingot then was vacuum carburized at 1100 degrees C. with a total time of 65 seconds, frozen in liquid nitrogen for 1-2 hours, compressed by a modified compression tester following the "axial compression testing" method stated in the ASM Handbook®, Volume 8, Mechanical Testing and Evaluation at liquid nitrogen temperature for 10-15 minutes, and tempered at 482 degrees C. for a total time of 48 hours or 56 hours (see FIG. 1) in seven (7) "tempering-liquid nitrogen freeze" cycles.

After the carburizing-quenching-cryogenic treatment-cryogenic deformation-cyclic tempering, a case hardness of 68-69 Rc and a core hardness of 50 Rc were achieved in the CryoForm 70 steel. FIG. 1 presents the hardness profile after the processing depending on tempering temperature.

Figure 2:
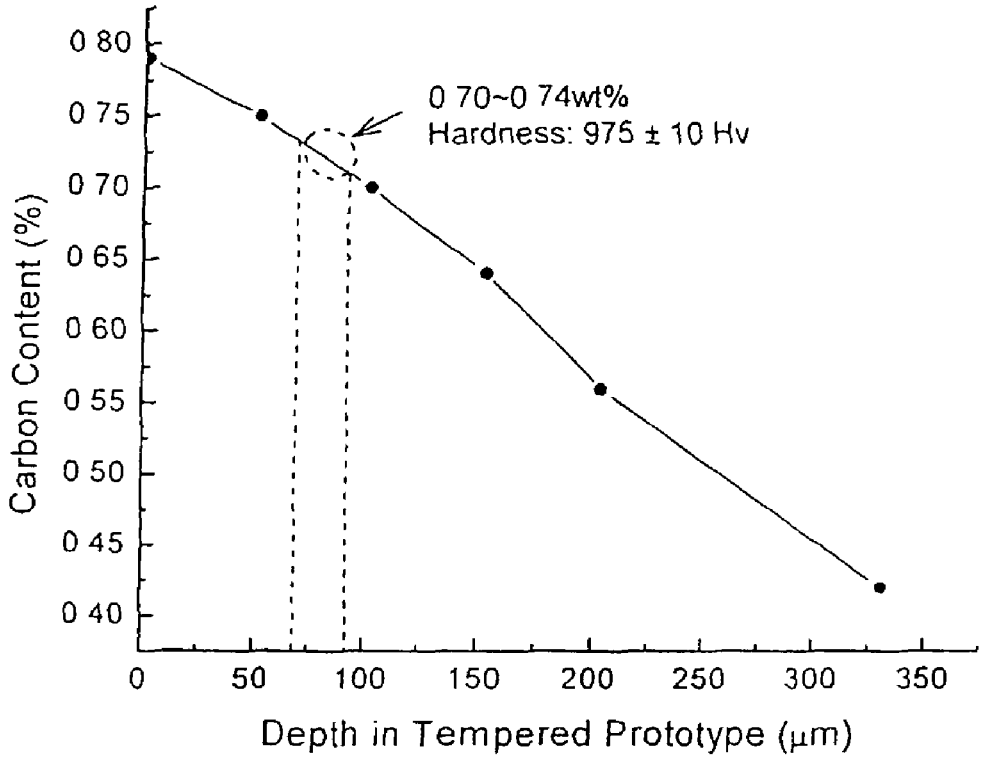
FIG. 2 is a carbon content profile of Cryoform 70 steel after vacuum carburizing.

FIG. 2 displays the corresponding carbon content profile of CryoForm 70 steel after carburizing. The case carbon content is about 0.70-0.74 weight % at a case depth of about 70-100 microns and nearly 0.80 weight % at the carburized case surface.

The secondary hardening CryoForm 70 steel provides a case hardness of 975±10 Hv at the case carbon level of 0.70-0.74 weight % and a core hardness of 512 Hv to provide a beneficial combination of case strength and core toughness and for superior wear and fatigue resistance. The achieved case hardness is a 35% improvement if compared to current commercial case hardness of 720 Hv, and an 8% increase in hardness with respect to Ferrium® C67 steel.

Figure 3:
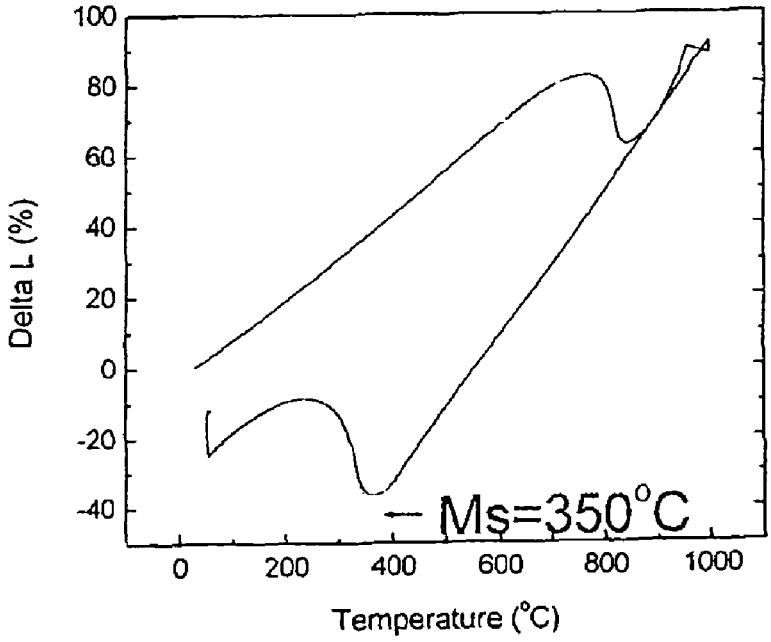
FIG. 3 shows core Ms (martensite-start) temperature of the Cryoform 70 steel measured using dilatometry wherein Delta L (%) is dilation expressed as length change percent.

The core martensite transformation temperature Ms was measured using dilatometry and the result is shown in FIG. 3. A core Ms temperature of about 350 degrees C. is shown.

Secondary hardening steels pursuant to the invention have potential commercial applications that include, but are not limited to, camshafts and gears for power transmission systems in race cars, aircrafts and heavy machines. The steel can also be applied to machining tool, cutlery and sporting goods industries.

Although certain illustrative embodiments of the present invention have been set forth above, those skilled in the art will appreciate that modifications and changes can be made therein within the scope of the invention as set forth in the appended claims.

The invention claimed is:

1. A secondary hardening steel consisting essentially of, in weight %, 3.7% to 3.73% Ni, about 9.9% to 10.2% Co, about 5.3% to about 5.4% Cr, about 2.5% to about 152% Mo, about 0.20% to about 0.21% V, about 0.1% to about 0.12% C, and balance Fe, said steel being case hardened to have a case carbon content of about 0.72 weight % to about 0.8 weight %.

2. The steel of claim 1 which has a case hardness of about 68-69 Rockwell C.

3. The steel of claim 1 having a core carbon content is of about 0.1 weight % to about 0.12 weight % and a core hardness of about 50 Rockwell C.

4. A case hardened secondary hardening steel, nominally consisting essentially of in weight %, about 10% Co, about 3.73% Ni, about 5.34% Cr, about 2.52% Mo, about 0.21% V, and balance Fe with a case carbon content of about 0.72 to 0.8 weight % and a core carbon content of about 0.1 weight % to 0.12 weight %.

5. A case hardened, secondary hardening Ni—Co steel having a Ni content of 3.7 to about 3.73 weight % and a Co content of about 9.9 weight % to 10.2 weight % and having a case carbon content of about 0.72 weight % to about 0.8 weight %, a case hardness of about 68-69 Rockwell C, and a core hardness of about 50 Rockwell C.

* * * * *

UNITED STATES PATENT AND TRADEMARK OFFICE

CERTIFICATE OF CORRECTION

PATENT NO. : 8,157,931 B2
APPLICATION NO. : 12/459477
DATED : April 17, 2012
INVENTOR(S) : Yana Qian et al.

It is certified that error appears in the above-identified patent and that said Letters Patent is hereby corrected as shown below:

Column 4, Claim 1, line 23; replace “152%” with --2.52%--.

Signed and Sealed this
Twelfth Day of June, 2012

David J. Kappos

David J. Kappos
*Director of the United States Patent and Trademark Office*